US011198931B2

(12) United States Patent
James

(10) Patent No.: US 11,198,931 B2
(45) Date of Patent: Dec. 14, 2021

(54) PROCESS FOR PREVENTING RECRYSTALLIZATION OF SHOT PEENED BLADE ROOTS DURING A HEAT TREATMENT PROCESS

(71) Applicant: Siemens Aktiengesellschaft, Munich (DE)

(72) Inventor: Allister William James, Chuluota, FL (US)

(73) Assignee: Siemens Energy Global GmbH & Co. KG, Munich (DE)

( * ) Notice: Subject to any disclaimer, the term of this patent is extended or adjusted under 35 U.S.C. 154(b) by 47 days.

(21) Appl. No.: 16/778,661

(22) Filed: Jan. 31, 2020

(65) Prior Publication Data

US 2021/0062317 A1 Mar. 4, 2021

Related U.S. Application Data

(60) Provisional application No. 62/893,449, filed on Aug. 29, 2019.

(51) Int. Cl.
*C22F 1/10* (2006.01)

(52) U.S. Cl.
CPC ..... *C22F 1/10* (2013.01)

(58) Field of Classification Search
CPC ..... C22F 1/10; C21D 7/06
See application file for complete search history.

(56) References Cited

FOREIGN PATENT DOCUMENTS

EP 2450146 A1 * 5/2012 ..... C23C 28/345

* cited by examiner

*Primary Examiner* — Jessee R Roe

(57) ABSTRACT

There is provided a process for heat treating a component (30) having a first section (32) and a section shot peened section (34), the first section (32) and shot peened second section (34) formed from a nickel-based gamma prime strengthened superalloy. The process includes heating the first section (32) to at least a gamma prime solvus temperature thereof; and during the heating of the first section (32) to at least the gamma prime solvus temperature thereof, preventing the shot peened second section (34) from reaching a recrystallization temperature thereof.

13 Claims, 3 Drawing Sheets

PROCESS FOR PREVENTING RECRYSTALLIZATION OF SHOT PEENED BLADE ROOTS DURING A HEAT TREATMENT PROCESS

FIELD

The present invention relates generally to heat treatment processes for components having a first section and a shot peened second section, and more particularly to processes that allow the first section to reach a gamma prime solvus temperature to solution and reprecipitate the gamma prime content of the first section while preventing the shot peened second section from reaching its recrystallization temperature in order to avoid the nucleation of secondary grains and undesired grain growth in the second section.

BACKGROUND

Blades are employed in different regions of combustion turbine engines. As is known in the relevant art, such combustion turbine engines typically include a compressor stage, a combustor stage, and a turbine stage. Air is drawn into the engine and compressed by the compressor stage, with fuel being mixed with the compressed air and the fuel/air mixture being combusted in the combustor stage. The hot combusted gases then flow through the turbine stage and thereafter exit the engine. The compressor and turbine stages of the engine typically include a plurality of blades that are mounted on a common rotating shaft. The compressor and turbine stages each additionally include one or more rows of stationary vanes or stators that cooperate with the blades mounted on the rotating shaft to compress air in the compressor stage, and to derive mechanical power from high velocity gases in the turbine stage.

Due to the substantial temperatures incurred during gas turbine operation, the components in the hot gas path surface, e.g., turbine blades, are particularly prone to thermal damage, including fatigue cracks and the like. The benefits of shot peening root sections of turbine blades are well known, and the peening processes are widely employed in the gas turbine industry. Since fatigue cracks generally begin at surface imperfections, a compressively stressed peened skin is highly effective in preventing crack formation and growth. Peening introduces compressive residual stress in a surface, thereby increasing the fatigue resistance.

Notwithstanding the above benefits, the stored strain energy resulting from peening drives undesirable recrystallization of the material when exposed to high temperature heat treatments, such as rejuvenation heat treatments and brazing. Recrystallization leads to the formation of new grains and a significant reduction in the mechanical (e.g. creep and fatigue) properties. Currently, the majority of advanced gas turbine front stage blades are manufactured from gamma prime-strengthened nickel-based superalloys. These alloys are often cast with a single crystal (SX) or directionally solidified (DS) microstructure. Grain formation is a major concern in SX components since SX alloys do not contain grain boundary strengthening elements, and although DS alloys contain some grain boundary strengtheners, grain boundaries resulting from recrystallization may not be adequately strengthened in DS materials. As the majority of advanced gas turbine front stage blades are manufactured from gamma prime-strengthened nickel-based superalloys, the recrystallization phenomenon poses a considerable challenge.

Two different approaches have been adopted for mitigating recrystallization in the roots of turbine blades. The first is simply to not peen the roots and accept that the fatigue resistance will not be optimized. The second is to peen the roots and accept that the parts cannot thereafter be exposed to temperatures that will cause recrystallization. This recrystallization temperature is typically around 70-100° C. below the solution heat treatment temperature. This reduced head treatment temperature limitation prevents one from obtaining the full benefit of the intended heat treatment process as the strengthening gamma prime phase cannot be fully solutioned and reprecipitated in the desired morphology. The recrystallization temperature limitation also prevents structural brazing, and other high temperature operations, such as blade tip core print closeout.

BRIEF DESCRIPTION OF THE DRAWINGS

The invention is explained in the following description in view of the drawings that show.

SUMMARY

The present invention is directed to processes for the heat treatment of gamma prime strengthened superalloy turbine blades after peening. The processes enable an airfoil section of the turbine blade to be heated above its recrystallization temperature while avoiding the onset of recrystallization in the shot peened root section.

Advantageously, the processes described herein may be applied to the manufacture of new parts where operations such as structural brazing or blade tip closure are required after blade root peening, and also to the rejuvenation of service run turbine blades.

In certain aspects, the processes utilize the differential heating rates associated with the two different section sizes of the blade to allow a first (e.g., airfoil) section to reach the solution heat temperature, while preventing a second (e.g., root section) from reaching its recrystallization temperature. In an embodiment, the root section is prevented from reaching its recrystallization temperature by artificially increasing the mass of the root section, such as by surrounding the root section with a large (relative to the airfoil) block during a heat treatment process.

In accordance with an aspect, there is provided a process for heat treating a component having a first section and a shot peened second section, the first section and shot peened second section formed from a nickel-based gamma prime strengthened superalloy, the process comprising:

heating the first section to at least a gamma prime solvus temperature thereof; and during the heating of the first section to at least the gamma prime solvus temperature thereof, preventing the shot peened second section from reaching a recrystallization temperature thereof.

In accordance with another aspect, there is provided a process for heat treating a turbine component having an airfoil section and a shot peened root section, the airfoil section and the shot peened root section formed from a nickel-based gamma prime strengthened superalloy, the process comprising:

heating the airfoil section to at least a gamma prime solvus temperature thereof; and during the heating of the airfoil section to at least the gamma prime solvus temperature thereof, preventing the shot peened root section from reaching a recrystallization temperature thereof.

DETAILED DESCRIPTION

Figure 1:
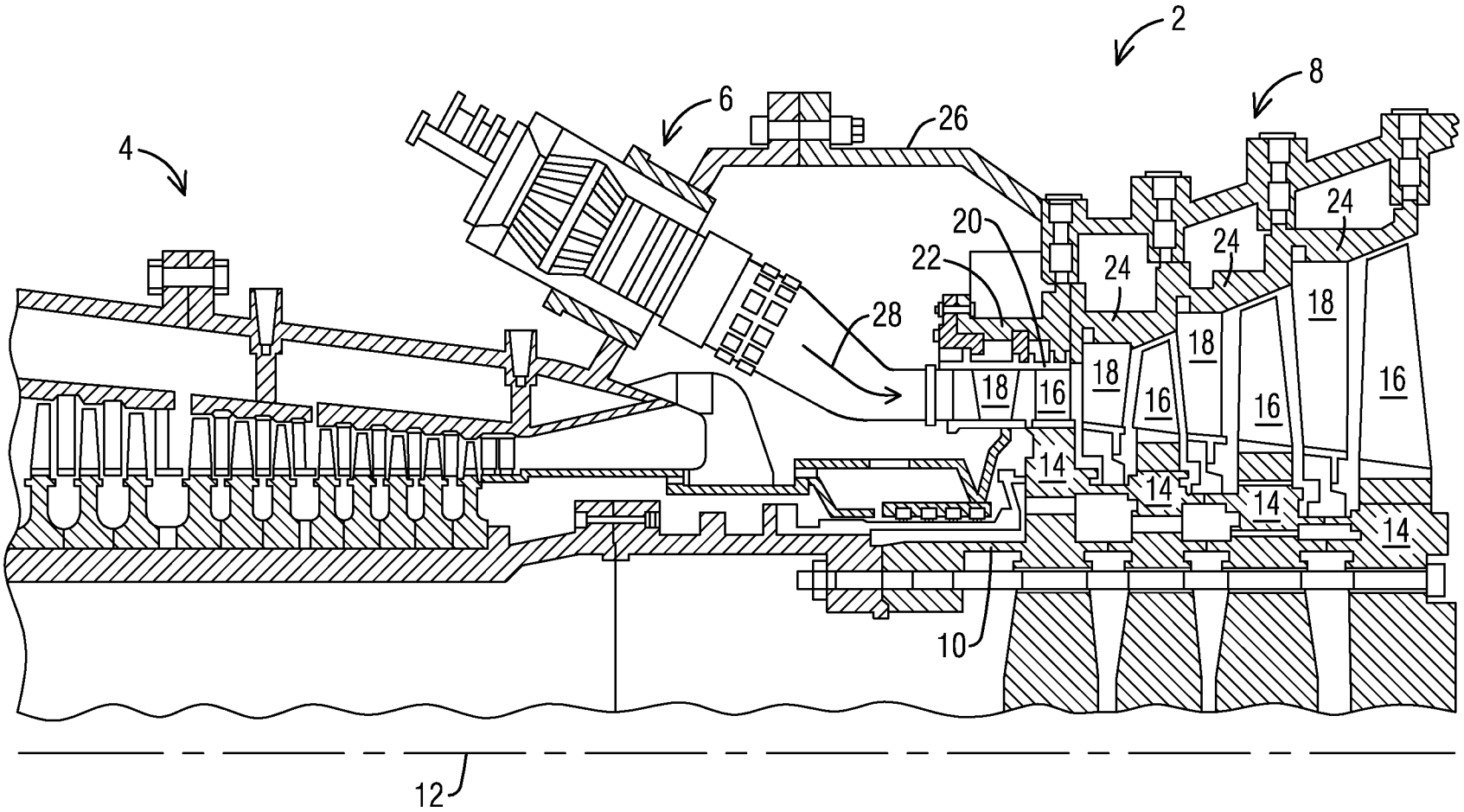
FIG. 1 is a schematic of a gas turbine engine having components suitable for use with the present invention.

Now referring to the figures, FIG. 1 illustrates a gas turbine engine in accordance with an aspect of the present invention. The gas turbine engine 2 includes a compressor section 4, a combustor section 6, and a turbine section 8. In the turbine section 8, there are alternating rows of stationary airfoils 18 (commonly referred to as "vanes") and rotating airfoils 16 (commonly referred to as "blades"). Each row of blades 16 is formed by a circular array of airfoils connected to an attachment disc 14 disposed on a rotor 10 having a rotor axis 12. The airfoils 16, 18 extend spanwise along a radial direction of the axis 12 of the gas turbine engine 2. The blades 16 extend radially outward from the rotor 10 and terminate in blades tips. The vanes 18 extend radially inward from an inner surface of vane carriers 22, 24 which are attached to an outer casing 26 of the engine 2. Between the rows of vanes 18 a ring seal 20 is attached to the inner surface of the vane carrier 22. The ring seal 20 is a stationary component that acts as a hot gas path guide between the rows of vanes 18 at the locations of the rotating blades 16. The ring seal 20 is commonly formed by a plurality of ring segments that are attached either directly to the vane carriers 22, 24 or indirectly such as by attachment to metal isolation rings (not shown) attached to the vane carriers 22, 24. During engine operation, high-temperature/high-velocity gases 28 flow primarily axially with respect to the rotor axis 12 through the rows of vanes 18 and blades 16 in the turbine section 8.

Figure 2:
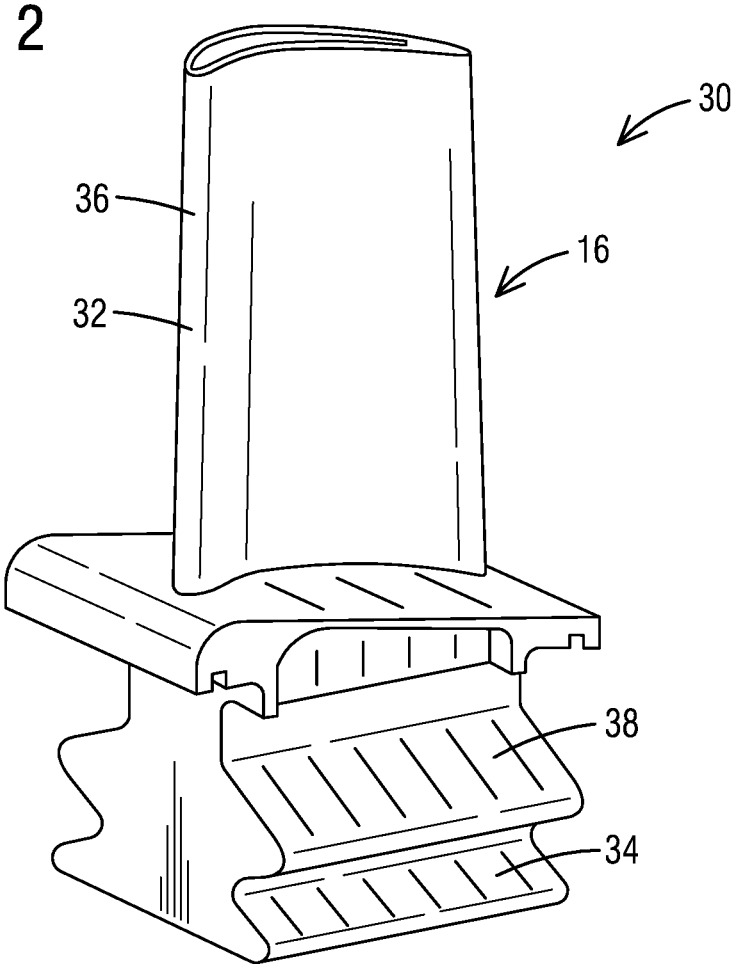
FIG. 2 illustrates a component having a first section (e.g., airfoil section) and a shoot peened shot peened second section (e.g., shot peened root section) in accordance with an aspect of the present invention.

FIG. 2 illustrates a component 30 in accordance with an aspect of the present invention. It is understood that the component 30 may comprise any structure having a first section and a shot peened second section, wherein the first section is allowed to reach its solution heat temperature while the shot peened second section from reaching its recrystallization temperature. In an embodiment, the component 30 comprises a turbine component, such as a blade 16; however, it is understood that the present invention is not so limited. In other embodiments, the component 30 may comprise a vane 18. The component 30 comprises a first section 32 and a shot peened second section 34 (hereinafter "shot peened second section").

By "shot peened," it is meant that any process that imparts a compressive stress to a surface of the component of the component 30, and thereby enhancing resistance to fatigue damage. Generally, shot peening entails impacting a surface with particles (round metallic, glass, or ceramic particles) with force sufficient to create deformation of the impacted surface. In this way, each particle functions akin to a ball-peen hammer. In the embodiment shown, the first section 32 comprises an airfoil section 36 of a blade 16 and the shot peened second section 34 comprises a shot peened root section 38 of the blade, wherein the airfoil section 36 extends radially from the shot peened root section 38. In an embodiment, the shot peened second section 34 is shot peened but the first section 32 is not.

In addition, the first section 32 and the shot peened second section 34 comprise a nickel-based gamma prime strengthened superalloy. The nickel-based gamma prime strengthened superalloy may comprise a base of nickel along with cobalt, iron, aluminum, titanium, niobium, tantalum, chromium, or other appropriate elements in various combinations and proportions. Further, the sections 32, 34 may be cast with a single crystal (SX), directionally solidified (DS), equiaxed microstructure.

In accordance with an aspect of the present invention, there is provided a process for heat treating the turbine component 30. The process comprises heating the first section 32 (e.g., airfoil section 36) to at least a gamma prime solvus temperature of the first section 32. Heating the component to a temperature at or above the gamma prime solvus temperature typically dissolves the coarse gamma prime structure. This heat treatment is then followed by rapid cooling and reheating to a temperature below the gamma prime solvus temperature for controlled reprecipitation of the gamma prime phase. The gamma prime solvus temperature may be measured by any suitable process or solution, such as by differential thermal analysis (DTA), measurement of the coefficient of thermal expansion (CTE), and/or by standard metallographic techniques. In other embodiments, the gamma prime solvus temperature and recrystallization temperatures may be determined for a particular alloy by commercially available software for the same, such as commercially available software such as JMatPro®, available from Sente Software Ltd. or Thermo-Calc, available from Thermo-Calc Software Inc.

In addition, the process comprises, during the heating of the first section 32 (e.g., airfoil section 36) to at least the gamma prime solvus temperature, preventing the shot peened second section 34 (e.g., shot peened root section 38) from reaching a recrystallization temperature thereof. The recrystallization temperature is below the gamma prime solvus temperature and is the temperature at which new grains will form in the microstructure of the alloy. The prevention of the shot peened second section 34 (e.g., shot peened root section 38) from reaching its recrystallization temperature also prevents the onset of recrystallization in the shot peened second section 34, thereby substantially reducing the likelihood of thermal stress-induced cracking and fatigue damage over the lifetime of the component 30.

In an embodiment, the preventing the shot peened second section 34 from reaching a recrystallization temperature is done by encompassing the shot peened second section 34 within a housing 40 which retards a heating rate of the shot peened second section 34. By encompassing, it is meant that at least a majority of the shot peened second section 34 is surrounded by the housing 40 to a degree sufficient to retard a heating rate of the shot peened second section 34 to maintain the shot peened second section below the recrystallization temperature. In an embodiment, the component 30 is a turbine component 16, 18 having the airfoil section 36 and the shot peened root section 38, and all of the shot peened root section 38 is encompassed by the housing 40 with the exception of a platform component 35 thereof. In other embodiments, all of the available surface of the shot peened root section 38 is encompassed by the housing 40.

Figure 3:
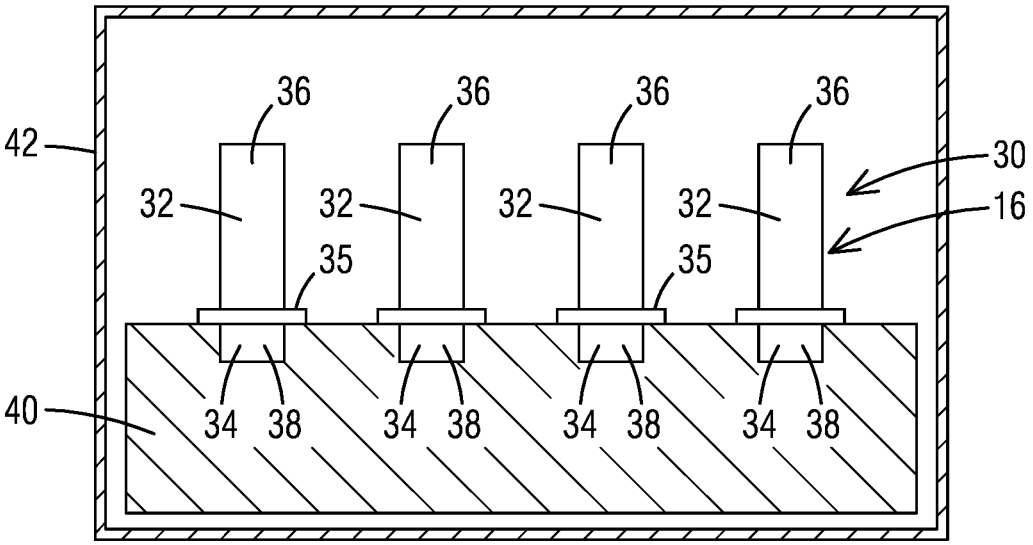
FIG. 3 illustrates an embodiment of a housing for carrying out a component of a process in accordance with an aspect of the present invention.

In an embodiment, the housing 40 comprises a metal material, in certain embodiments an alloy material, and in particular embodiments generally comprises a superalloy material. Referring now to FIG. 3, FIG. 3 illustrates the housing 40 disposed within a furnace 42. The housing 40 comprises one or more slots formed therein for receiving the shot peened second section 34 (e.g., root section 38) of the component 30. The close fit between the shot peened second section 34 and the slots allow for thermal contact between the blade roots and the housing 40. The remainder of the component 30, namely the first section 32 (e.g., airfoil section 36) is exposed to the atmosphere and thus the heat of the furnace. In this way, the comparatively thinner first section 32 (relative to the shot peened second section 34) can be heated at least to the gamma prime solvus temperature. Meanwhile, the shot peened second section 34 is kept from heating to or above its recrystallization temperature, such as by retarding the heating rate of the shot peened second section 34 by substantially increasing its mass via the housing 40.

In accordance with an aspect, the housing 40 may comprise an additional structure for enhancing a degree of the thermal insulation of the housing 40 to further retard the heating rate. In an embodiment, the housing 40 may comprise a thermally insulating layer, for example. In other embodiments, the housing 40 may be cooled by any suitable process periodically or continuously, such as by periodically or continuously flowing a cooling liquid or gas through the housing to again retard the heating rate. In certain embodiments, thermocouples may be located within or adjacent to the second (e.g., root) sections for temperature monitoring. Given that heat treatments of turbine blades 16 are generally performed in a vacuum furnace or under an inert protective atmosphere, the arrangement of the housing 40 shown in FIG. 3 can be inserted into a furnace chamber without the need for cooling to maintain the second (e.g., root) sections below the recrystallization temperature.

Figure 4:
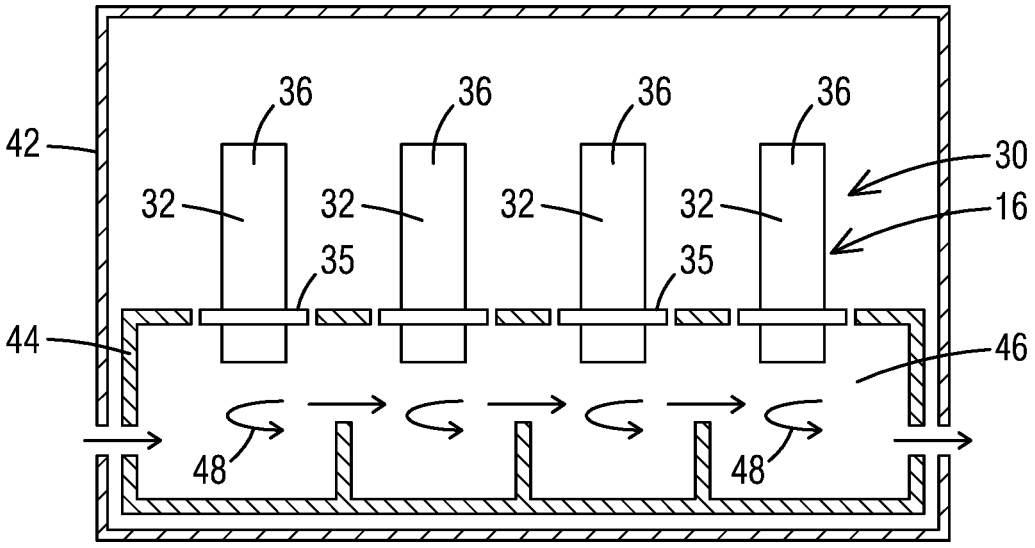
FIG. 4 illustrates an embodiment of a housing for carrying out a component of a process in accordance with another aspect of the present invention.

In accordance with another aspect, the preventing the shot peened second section 34 from reaching the recrystallization temperature thereof is done via encompassing the shot peened second section 34 within a housing 44 having a cavity 46 formed therein, and flowing a cooling fluid 48 through the cavity of the housing 44 about the shot peened second section 34. To illustrate, FIG. 4 shows a furnace 42 which encompasses the housing 44 therein. Similar to housing 40, the housing 44 comprises one or more slots for receiving one or more corresponding second (e.g., root) sections 34 therein. In this embodiment, the housing 44 comprises a cavity having a volume sufficient enough to allow sufficient cooling fluid 48 to flow therethrough in order to retard the heating rate of the housing 44 and prevent the shot peened second (e.g., root) sections 34 from reaching a recrystallization temperature thereof. The cooling fluid 48 may comprise any liquid, gas, or other medium effective to retard the degree of heating of the housing 44 to a desired degree. In an embodiment, the cooling fluid 48 comprises an inert gas.

The above processes allow, for example, the airfoil section of a turbine blade to reach its gamma prime solvus temperature, and be fully solutioned and reprecipitated while the shot peened root portion is prevented from recrystallizing which would typically result in fatigue cracks or other damage. In accordance with other aspect, the heat treatment processes described herein may include a pre-treatment or post-treatment step to the above-described heat treatment processes.

In accordance with one aspect, prior to the heating of the first section 32 to at least a gamma prime solvus temperature thereof and prior to heating the shot peened second section 34 to a temperature below the recrystallization temperature thereof, the processes described herein may further comprise pre-heating the first section 32 to a temperature below a recrystallization temperature of both the first section 32 and the shot peened second section 34. Typically, this pre-treatment step may be utilized as a partial solution heat treatment step employed as part of a rejuvenation cycle, for example. Such a cycle allows for partial dissolution of overaged gamma prime with an extended hold time at an elevated temperature below the recrystallization temperature. In certain embodiments, the pre-treatment step may be performed without disposing the component 30 within a housing, e.g., housing 40 or 44. The pre-treatment step may take for a suitable duration, such as for a duration of from 1 to 4 hours. The post treatment (aging) step may have a duration between 1 and 24 hours and may comprise more than one post treatment.

In accordance with another aspect, after the heating the first section (32) to at least a gamma prime solvus temperature thereof and after heating the shot peened second section 34 to a temperature below the recrystallization temperature thereof, the processes described herein may also further comprise subjecting the first section 32 and the shot peened second section 34 to a post-heat treatment step comprising reheating the first section 32 and the shot peened second section 34 to a temperature below a recrystallization temperature of both the first section 32 and the shot peened second section 34. In an embodiment, the post-treatment step enables the fast cooling of the shot peened second section 34 and may be used to restore the fine gamma prime structure in the shot peened second section 34. Similar to the pre-treatment step, the post-treatment step may be performed without disposing the component 30 within a housing, e.g., housing 40 or 44. The pre-treatment step may take for a suitable duration, such as for a duration of from 1 to 4 hours.

While various embodiments of the present invention have been shown and described herein, it will be obvious that such embodiments are provided by way of example only. Numerous variations, changes, and substitutions may be made without departing from the invention herein. Accordingly, it is intended that the invention be limited only by the spirit and scope of the appended claims.

The invention claimed is:

1. A process for heat treating a component (30) having a first section (32) and a shot peened second section (34), the first section (32) and shot peened second section (34) formed from a nickel-based gamma prime strengthened superalloy, the process comprising:

heating the first section (32) to at least a gamma prime solvus temperature thereof; and during the heating of the first section (32) to at least the gamma prime solvus temperature thereof, preventing the shot peened second section (34) from reaching a recrystallization temperature thereof.

2. The process of claim 1, wherein the preventing the shot peened second section (34) from reaching a recrystallization temperature is done by encompassing the shot peened second section (34) within a housing (40) which retards a heating rate of the shot peened second section (34).

3. The process of claim 2, wherein the housing (40) comprises a superalloy material.

4. The process claim 2, further comprising, prior to the heating the first section (32) to at least a gamma prime solvus temperature thereof and prior to heating the shot peened second section (34) to a temperature below the recrystallization temperature thereof, pre-heating the first section (32) to a temperature below a recrystallization temperature of both the first section (32) and the shot peened second section (34).

5. The process of claim 4, wherein the pre-heating is done for a duration of from 1 to 4 hours.

6. The process of claim 1, further comprising, after the heating the first section (32) to at least a gamma prime solvus temperature thereof and after heating the shot peened second section (34) to a temperature below the recrystallization temperature thereof, subjecting the first section (32) and the shot peened second section (34) to a post-heat treatment step comprising reheating the first section (32) and the shot peened second section (34) to a temperature below a recrystallization temperature of both the first section (32) and the shot peened second section (34).

7. The process of claim 6, wherein the post-heat treatment step is done for a duration of from 1 to 24 hours.

8. The process of claim 1, wherein the preventing the shot peened second section (34) from reaching the recrystallization temperature thereof is done via encompassing the shot peened second section (34) within a housing (44) having a cavity (46) and flowing a cooling fluid (48) through the cavity (46) and about the shot peened second section (34).

9. The process of claim 1, wherein the first section (32) and the shot peened second section (34) each comprise at least one of a single crystal, directionally solidified, or equiaxed microstructure.

10. The process of claim 1, further comprising utilizing the process in a brazing or rejuvenation heat treatment process for the turbine component.

11. The process of claim 1, wherein the component (30) comprises a turbine component (16, 18), wherein the first section (32) comprises an airfoil section (36), and wherein the shot peened second section (38) comprises a shot peened root section (40).

12. A process for heat treating a turbine component (16, 18) having an airfoil section (36) and a shot peened root section (38), the airfoil section (36) and the shot peened root section (38) formed from a nickel-based gamma prime strengthened superalloy, the process comprising:

heating the airfoil section (36) to at least a gamma prime solvus temperature thereof; and during the heating of the airfoil section (36) to at least the gamma prime solvus temperature thereof, preventing the shot peened root section (38) from reaching a recrystallization temperature thereof.

13. The process of claim 12, wherein the preventing the shot peened root section (38) from reaching a recrystallization temperature is done by encompassing the shot peened second section (34) within a housing (40) which retards a heating rate of the shot peened second section (34).

* * * * *